US010786095B2

(12) United States Patent
Jaconelli

(10) Patent No.: US 10,786,095 B2
(45) Date of Patent: Sep. 29, 2020

(54) SYSTEM FOR GLAZING AN OBJECT INTENDED TO ALLOW A PRODUCT TO BE DISPLAYED IN A VISUALLY ATTRACTIVE WAY, COOLED AND/OR KEPT AT A DESIRED TEMPERATURE

(71) Applicant: Didier Jaconelli, Aubervilliers (FR)

(72) Inventor: Didier Jaconelli, Aubervilliers (FR)

( * ) Notice: Subject to any disclaimer, the term of this patent is extended or adjusted under 35 U.S.C. 154(b) by 0 days.

(21) Appl. No.: 15/565,578

(22) PCT Filed: Apr. 5, 2016

(86) PCT No.: PCT/FR2016/050777
§ 371 (c)(1),
(2) Date: Oct. 10, 2017

(87) PCT Pub. No.: WO2016/162630
PCT Pub. Date: Oct. 13, 2016

(65) Prior Publication Data

US 2018/0116429 A1 May 3, 2018

(30) Foreign Application Priority Data

Apr. 10, 2015 (FR) ..... 15 53135

(51) Int. Cl.
*A47F 3/04* (2006.01)
*F25D 31/00* (2006.01)
(Continued)

(52) U.S. Cl.
CPC ..... *A47F 3/04* (2013.01); *A47F 3/0465* (2013.01); *A47F 3/0469* (2013.01);
(Continued)

(58) Field of Classification Search
CPC ..... F25F 17/02; F25D 31/006; F25D 31/007; F25D 17/02; F25D 2400/08;
(Continued)

(56) References Cited

U.S. PATENT DOCUMENTS 2,135,402 A * 11/1938 Korber ..... F25D 11/04 62/444
2,274,220 A * 2/1942 Sticelber ..... A21C 1/149 62/63

(Continued)

FOREIGN PATENT DOCUMENTS

| | | |
|---|---|---|
| FR | 1202899 A | 1/1960 |
| WO | 199002302 A1 | 3/1990 |
| WO | 200120967 A2 | 3/2001 |

OTHER PUBLICATIONS

International Search Report dated Jul. 8, 2016 for corresponding International Application No. PCT/FR2016/050777, filed Apr. 5, 2016.

(Continued)

*Primary Examiner* — Eric S Ruppert
*Assistant Examiner* — Hans R Weiland
(74) *Attorney, Agent, or Firm* — David D. Brush; Westman, Champlin & Koehler, P.A.

(57) ABSTRACT

A glazing system includes at least one object displaying at least one body to be glazed. The body to be glazed incorporates a sealed chamber extending inside the body, the chamber having at least one inlet situated at the bottom of the chamber and at least one evacuation outlet situated at the top of the chamber. The system includes a refrigeration device having a refrigeration circuit coupled to the inlet and the evacuation outlet. The refrigeration device circulates a refrigerated liquid between the inlet and the evacuation outlet.

10 Claims, 2 Drawing Sheets

(51) Int. Cl.
*F28D 7/12* (2006.01)
*F25D 17/02* (2006.01)
*F28F 3/12* (2006.01)

(52) U.S. Cl.
CPC ..... *A47F 3/0478* (2013.01); *F25D 17/02* (2013.01); *F25D 31/006* (2013.01); *F28D 7/12* (2013.01); *A47F 2003/0473* (2013.01); *F25D 2331/803* (2013.01); *F25D 2331/809* (2013.01); *F28F 3/12* (2013.01)

(58) Field of Classification Search
CPC .... F25D 2400/10; F25D 2400/18; F28D 7/12; A47F 3/04; A47F 3/0465; A47F 3/0469; A47F 3/0478; A47F 2003/0473
See application file for complete search history.

(56) References Cited

U.S. PATENT DOCUMENTS 3,888,092 A * 6/1975 Fisher ..... F25D 17/02 62/376
3,888,303 A * 6/1975 Skala ..... F25D 17/02 165/104.14
4,870,835 A * 10/1989 Wolfe ..... A47F 3/0486 62/246
5,168,712 A * 12/1992 Coelho ..... F25D 17/02 62/373
5,584,187 A 12/1996 Whaley
5,718,124 A * 2/1998 Senecal ..... A47F 3/0443 62/3.6
5,921,096 A 7/1999 Warren
6,460,375 B1 10/2002 Lundaas
7,347,055 B2 * 3/2008 Lucas ..... F25D 31/007 62/457.4
7,644,592 B2 * 1/2010 Kent ..... F25D 17/02 62/258
7,856,831 B2 * 12/2010 Flinner ..... F25D 31/007 62/3.2
9,068,773 B2 * 6/2015 Lintker ..... A47F 3/0439
2011/0041546 A1 * 2/2011 Linder ..... F25D 31/007 62/457.2
2011/0186591 A1 * 8/2011 Pfister ..... F25D 31/007 221/97
2016/0153709 A1 * 6/2016 Elbel ..... F25D 31/007 62/157

OTHER PUBLICATIONS

English translation of the International Written Opinion dated Sep. 5, 2017 for corresponding International Application No. PCT/FR2016/050777, filed Apr. 5, 2016.
French Preliminary Search Report dated Feb. 16, 2016 for French Application No. FR 1553135, filed Apr. 10, 2015.

* cited by examiner

SYSTEM FOR GLAZING AN OBJECT INTENDED TO ALLOW A PRODUCT TO BE DISPLAYED IN A VISUALLY ATTRACTIVE WAY, COOLED AND/OR KEPT AT A DESIRED TEMPERATURE

CROSS-REFERENCE TO RELATED APPLICATIONS

This Application is a Section 371 National Stage Application of International Application No. PCT/FR2016/050777, filed Apr. 5, 2016, the content of which is incorporated herein by reference in its entirety, and published as WO 2016/162630 on Oct. 13, 2016, not in English.

FIELD OF THE DISCLOSURE

The field of the invention is that of methods for displaying consumer goods in a chilled environment. More specifically, the invention relates to a system comprising a glazed object allowing products to be displayed in an attractive way, while bringing said products to a suitable temperature or while maintaining them at said temperature.

BACKGROUND OF THE DISCLOSURE

According to a conventional use, ice blocks can be sculpted in order to be used as display stands. Ice sculptures designed to display edible products can thus be found, in addition to bowl-shaped ice sculptures designed to support bottles of beverages that must be kept chilled.

These ice sculptures can be particularly impressive from a visual perspective. However, they have the drawback of having a short life and of melting under positive temperatures. These sculptures are thus only ephemeral and also risk causing deterioration to the products that they must display (for example in the event of melting or splitting of the ice, the products are likely to fall if not supported correctly).

The prior art also proposes display objects that are made, for example, from metal and that contain ice. These objects thus allow for products to be displayed and kept chilled.

These display objects therefore allow chilled products to be kept or beverages to be maintained at a temperature of 0° C. Moreover, these display objects can be produced such that they have an appearance that suits festive atmospheres. Nonetheless, this type of display object is not suitable for displays that are required to last for several hours. Indeed, in the event of a positive temperature, the ice melts and the objects eventually warm up.

According to another drawback of ice sculptures or display objects using ice, there is a possibility that the products displayed become wet from the water that is produced by the melting of the ice. In the example of bottles of beverages having an adhesive label, the water produced by melting can quickly wet the label on said bottles and result in the deterioration of the appearance thereof or result in them detaching from the bottles on which they are positioned.

The prior art further proposes chilled display cabinets. These display cabinets allow products to be kept chilled while allowing said products to be viewed from outside.

Chilled display cabinets therefore have the advantage of keeping products in a chilled environment over a long period of time without the risk of deterioration caused by a temperature rise (unless the cooling system of the display cabinet is shutdown) or by the water produced by the melting of ice.

However, said chilled display cabinets have the drawback of not having a particularly high-quality visual impact and more specifically compared to ice sculptures or the aforementioned display objects.

The prior art also proposes devices allowing a preparation to be chilled; such a device is disclosed in the patent document published under number U.S. Pat. No. 3,888,303 A. This device comprises a refrigerated bowl in which products including ice or ice-cream can be prepared.

More specifically, this bowl includes a wall, the inner surface of which forms the cavity of the bowl. The wall incorporates a sealed chamber in which a refrigerated liquid flows in order to cool the inner surface. The sealed chamber has an inlet and an outlet, both of which are situated at the bottom of the chamber, in addition to a partition travelling across the entire chamber as far as the upper ends of the chamber, where it forms a rim defining a passage, around the entire circumference of the bowl, between a portion of the chamber in contact with the inner surface and an external portion of the chamber. This partition thus allows the sealed chamber to be easily divided into two portions such that the cooled liquid arriving in the chamber is exclusively situated in the portion of the chamber that is in contact with the inner surface in order to chill said inner surface and cool the cavity of the bowl.

However, such a device has the drawback of not allowing a product to be displayed. If, however, this device was used to display a product, this display would depend only on the material used to constitute the outer surface of the wall of the bowl, in addition to the shape of this outer surface. Further drawbacks can also be observed, such as the air that tends to remain inside the sealed chamber during operation of the device, and the non-uniform flow of the refrigerated liquid inside the sealed chamber.

A device for chilling bottles is also known in the prior art, said device using a refrigerated liquid vessel in which the one or more bottles are immersed. Such a device is disclosed in the patent document published under number WO90/02302 A1.

In this device, a vessel has refrigerated liquid intake pipes situated at the bottom of the vessel and positioned so as to create a swirling flow of refrigerated liquid in the vessel. A bottle immersed in the vessel is thus effectively chilled by this swirling flow. The refrigerated liquid is then removed from the vessel via overflows located at the top of the vessel and opening out into a chamber. The refrigerated liquid is poured into the chamber and then removed via drainage pipes situated at the bottom of the chamber.

This type of device has the aforementioned drawbacks, including the fact that:

- the bottle is in direct contact with the refrigerated liquid, thus deteriorating (by wetting) any label adhered to the surface thereof;
- the device is not intended to be visually attractive, or is not particularly attractive.

SUMMARY

The purpose of an exemplary embodiment of the invention is in particular to overcome these drawbacks of the prior art.

More specifically, the purpose of an exemplary embodiment of the invention is to propose a system for displaying products that must be kept in a chilled environment and that is particularly attractive from a visual perspective compared to that provided for in the prior art.

Another purpose of an exemplary embodiment of the invention is to propose such a system that allows for a long-lasting display.

Yet another purpose of an exemplary embodiment of the invention is to propose such a system that does not allow the products displayed to be deteriorated.

These purposes, in addition to others that will appear hereinbelow, are achieved by using an exemplary embodiment of the invention, which relates to a glazing system comprising at least one object displaying at least one body to be glazed, characterised in that the body to be glazed incorporates a sealed chamber extending inside said body, the chamber having at least one inlet situated at the bottom of the chamber and at least one evacuation outlet situated at the top of the chamber, and in that the system comprises a refrigeration device comprising a refrigeration circuit coupled to the inlet and the evacuation outlet, the refrigeration device being intended to circulate a refrigerated liquid between the inlet and the evacuation outlet, and in that the chamber incorporates at least one dip tube providing the evacuation outlet, the dip tube being situated inside the chamber and communicating with the refrigeration circuit.

Such a system according to an exemplary embodiment of the invention allows the body to be glazed to be brought to a temperature of less than 0° C. Indeed, when the system is in operation, the refrigerated liquid completely fills the sealed chamber of the body to be glazed and cools the body to be glazed.

More specifically, given that the chamber extends within the body to be glazed, the entire body to be glazed is cooled in a homogeneous manner. This chamber allows the contact with the refrigerated liquid to be homogenised, unlike that which would be allowed, for example, by a conventional coil comprising a gas coolant. Such a coil circulating within the body to be glazed would create a non-homogeneous cooling of the body to be glazed and at an uncontrolled temperature that would depend on the gas coolant used. Indeed, a coil of this type has a more or less significant temperature difference between the two ends thereof, in particular depending on the length thereof and on the gas coolant used.

In other words, the presence of one or more refrigerated liquid inlets at the bottom of the chamber and of one or more evacuation outlets at the top of the chamber, optimises the degree of uniformity of the refrigerated liquid flow from the bottom to the top of the chamber, and the degree of uniformity of the transfer of heat energy from the body to be glazed to the refrigerated liquid, thus resulting in the homogeneous cooling of said body to be glazed. Moreover, the one or more evacuation outlets situated at the top of the chamber optimise the evacuation of air that may have been trapped inside the chamber and that would be located at the top of the chamber, thus preventing any deterioration of the capacity of the refrigeration device according to an exemplary embodiment of the invention to produce the homogeneous cooling of the body to be glazed.

The cooling of the body to be glazed results in a riming phenomenon on the outer surface of the body to be glazed, by condensation of the moisture contained in the air coming into contact with said outer surface.

Therefore, during system operation, rime propagates in a uniform manner on the body to be glazed until reaching a desired thickness (by controlling the temperature of the refrigerated liquid and the system operating time relative to the outside temperature), at which rime stops propagating.

The system according to an exemplary embodiment of the invention therefore allows an object to be obtained, said object having a body that is entirely covered with a coat of rime, thus providing a particularly attractive or impressive aesthetic effect. The object having the glazed body can thus be used as a display object for products to be cooled and/or to be kept chilled.

Moreover, as long as the refrigeration device of the glazing system is in operation, the display of the products to be kept chilled is sustainable over time. Indeed, the glazed body allows products to be kept and displayed at a suitable temperature controlled to the nearest degree in an ambient temperature environment, in particular between −25° C. and 16° C. and, for example, at about 3° C.

Finally, through the rime formed at the surface of the body to be glazed and as long as the refrigeration device is in operation, the products displayed are kept at a constant storage temperature and do not become wet by the melting of water.

The one or more products displayed are more specifically brought to and kept at a suitable temperature thanks to the refrigerated air that is situated in the vicinity of the glazed body of the object of the refrigeration device according to an exemplary embodiment of the invention.

The dip tube is used to remove the refrigerated liquid having been used to cool the body to be glazed. Thanks to the dip tube, the body to be glazed does not have an evacuation pipe running from an upper end of the object. These one or more dip tubes thus contribute to the appearance of the object comprising the body to be glazed.

In other words, the one or more dip tubes cross the sealed chamber in order to position the one or more evacuation outlets at the top of the chamber. Such dip tubes contribute to the appearance of the object (whereby the latter can have no evacuation ducts extending from an upper portion of the object or of the body to be glazed), in addition to optimising the removal of any air trapped inside the chamber and to optimising the homogeneous cooling of the body to be glazed.

According to one theoretical example, in the event that the body to be glazed has a simple shape and that the chamber has the shape of a volume having a single uppermost point and no anfractuosity in which air could remain trapped (for example a spherical volume), a single dip tube positioned at the top of this volume is sufficient in order to produce the evacuation outlet.

According to another theoretical example, in the event that the body to be glazed has a complex shape and that the chamber has the shape of a volume having a plurality of "high points" separated from each other and/or anfractuosities, a plurality of dip tubes positioned at the top of these "high points" and these anfractuosities is required in order to produce the evacuation outlets. Indeed, these high points or these anfractuosities can trap air or hinder the correct distribution of the refrigerated liquid in the chamber. Therefore, in such a case, the plurality of dip tubes optimises the homogeneous cooling of the body to be glazed, and in particular by guaranteeing the complete filling of the chamber.

It is understood that the one or more dip tubes therefore optimise the capacity of the refrigeration device to propagate in a uniform manner a coat of rime on the one or more bodies to be glazed.

Advantageously, the refrigeration device comprises a refrigerated liquid vessel from which a pump feeds the inlet with refrigerated liquid, and said one or more dip tubes are coupled to a return pipe opening out into the vessel.

The refrigeration device can thus be offset relative to the object having the body to be glazed. In this manner, the refrigeration device can be hidden and the object alone can be positioned in a visible manner.

According to a preferred solution, the pump feeds the inlet via a supply pipe, and the supply pipe and the return pipe connect to the body to be glazed by passing through a base of the object.

Thanks to this solution, the refrigeration mechanism and in particular the refrigeration circuit of the object comprising the body to be glazed can be completely hidden from sight.

According to one advantageous characteristic, the supply pipe and the return pipe are of the isothermal type.

Thanks to this characteristic, the refrigeration device can be offset at a long distance from the object comprising the body to be glazed. For example, the refrigeration device and the object can be separated and positioned in two different rooms. This characteristic in particular allows the refrigeration device to be isolated so that it does not generate disturbances in the vicinity of the display object (operating noise produced by the refrigeration mechanism, vibrations, etc.).

Moreover, such pipes prevent the appearance of the riming phenomenon on the outer surface of said pipes.

Preferably, the vessel is of the isothermal type and the refrigeration device comprises a cooling evaporator immersed in the vessel.

According to one specific embodiment, the cooling evaporator is welded onto an inner surface of a partition of the vessel.

Such a refrigeration device is particularly easy to implement and inexpensive to produce. Indeed, it requires the use of known components and the production methods of which are proven.

According to one preferred embodiment, the object is a container formed by a wall that constitutes the body to be glazed.

The object thus takes on a shape that is adapted to suit the display and the preservation in a chilled environment of the bottles of beverages or food. Indeed, the glazing of the container allows a constant temperature to be maintained inside the container, said temperature being adapted to suit beverages or culinary preparations.

According to one advantageous characteristic, the glazing system comprises a device for collecting the water produced by defrosting.

This defrost water collection device is used to remove any defrost water that can appear so as not to allow water to accumulate and risk deteriorating the products to be displayed. The defrost water can advantageously be recycled in order to contribute to the cooling of the refrigeration device.

According to one preferred characteristic, the refrigeration device comprises an adjustable thermostat.

This characteristic allows the temperature in the vicinity of the glazed body to be adapted to suit the type of product to be displayed. For example, for bottles of "sparkling wine"-type beverages, the thermostat can be adjusted according to the ambient temperature, either manually or automatically, so that the storage temperature is about 3° C. or even, for bottles of "spirit"-type beverages, the thermostat can be adjusted so that the storage temperature is about −5° C.

Advantageously, the refrigeration device comprises a stand-alone power supply.

The system according to an exemplary embodiment of the invention can advantageously be used in an itinerant manner. For example, the system can be activated in a storage location in preparation of a festive event so that the object to be glazed is glazed prior to the delivery of the system at the site of the event. Provided with a stand-alone power supply, the system can be moved freely without the risk of defrosting the object.

BRIEF DESCRIPTION OF THE DRAWINGS

Other characteristics and advantages of the invention shall be better understood upon reading the following description given of a non-limitative preferred embodiment of the invention, provided for illustration purposes with reference to the appended drawings, in which.

DETAILED DESCRIPTION OF ILLUSTRATIVE EMBODIMENTS

Figure 1:
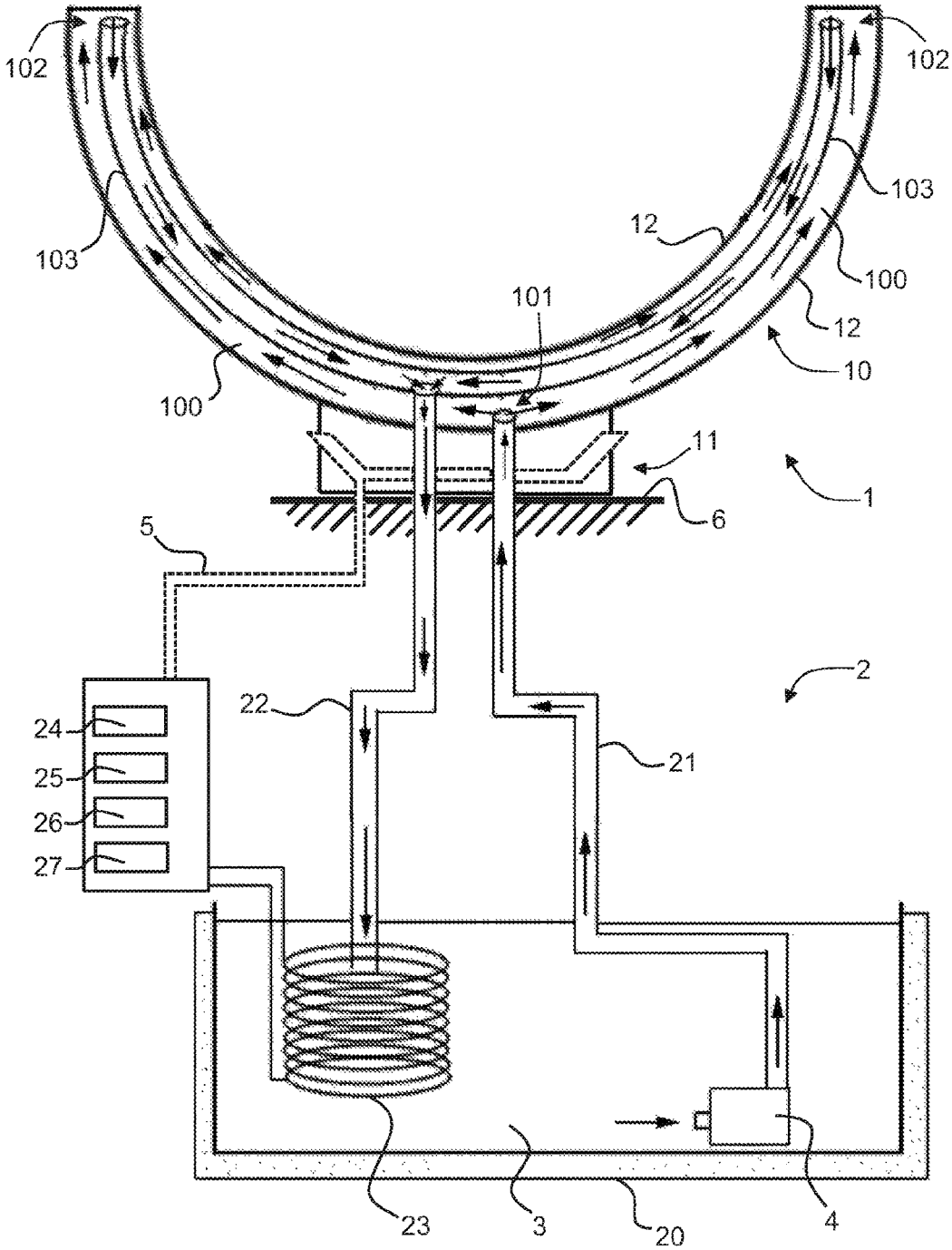
FIG. 1 is a diagrammatic view of a glazing system according to the invention.

With reference to FIG. 1, the glazing system according to an exemplary embodiment of the invention comprises at least one object 1 and a refrigeration device 2.

Figure 2:
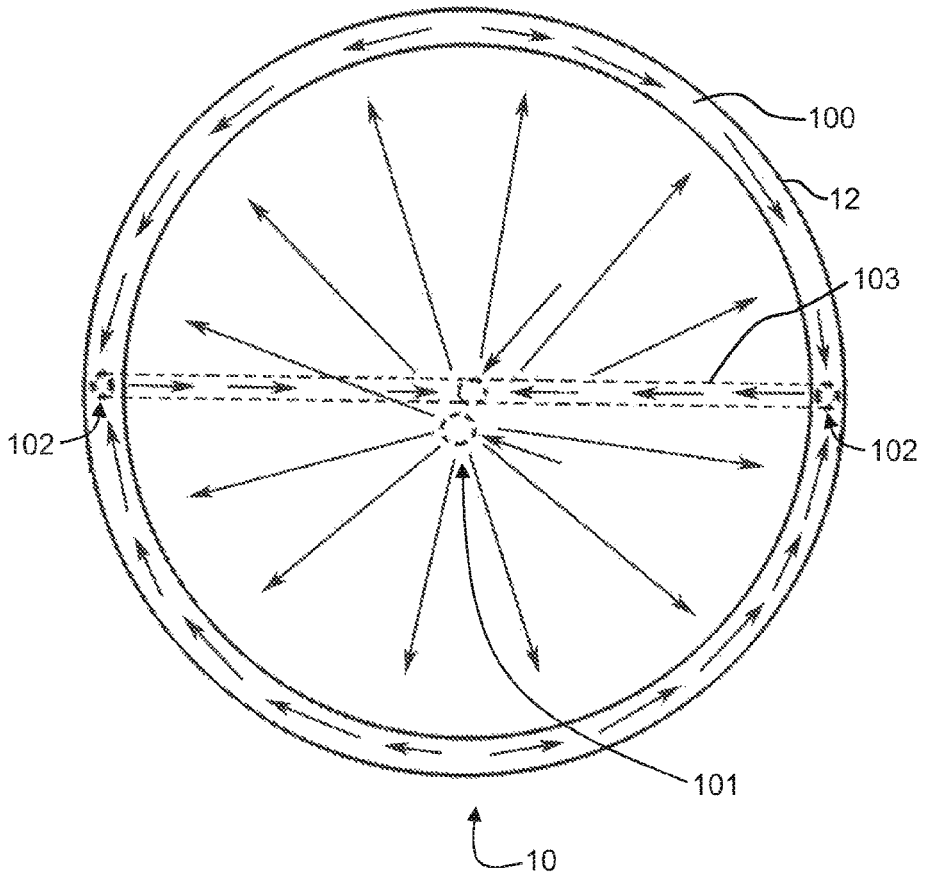
FIG. 2 is a diagrammatic, overhead view of a body to be glazed.

According to this embodiment illustrated in FIGS. 1 and 2, the object 1 is a container and has a base 11 and a body to be glazed 10 formed by a wall 12.

As shown, the body to be glazed 10 is incorporated into a sealed chamber 100 that extends within the body to be glazed.

The chamber 100 comprises:

- an inlet 101 situated in a low position at the bottom of the chamber;
- two evacuation outlets 102 situated in a high position, the evacuation outlets being constituted by a dip tube 103 incorporated inside the chamber.

The inlet 101 and the evacuation outlets 102 are coupled to a refrigeration circuit so as to circulate a refrigerated liquid 3 inside the chamber 100. The evacuation outlets are thus positioned at the top of the chamber so as to be able to drain the chamber of any air that may be present and of the refrigerated liquid that has filled the chamber and cooled the wall 12.

The refrigeration device 2 comprises the refrigeration circuit coupled to the inlet 101 and to the evacuation outlets 102 via the dip tube 103. More specifically, the refrigeration device comprises an isothermal vessel 20 housing the refrigerated liquid 3 from which runs a supply pipe 21 coupled to the inlet 101, and in which is immersed a return pipe 22 that is coupled to the dip tube 103. Therefore, the refrigerated liquid 3 flows from the vessel 20, cools the wall 12 that constitutes the body to be glazed 10 and returns to the vessel.

In order to allow the refrigerated liquid 3 to flow, a pump 4 immersed in the vessel 20 is coupled to the supply pipe 21. The pressure of the pump feeding the refrigeration circuit can vary and in particular lies in the range 1 bar to 30 bar during operation of the glazing system. This pressure variation allows the circuit to be adapted to suit the shape and inner spacings of the chamber. For example, if the chamber has a passage with a very low spacing, the pressure is increased in order to favour the correct flow of the refrigerated liquid through said passage and in order to obtain the homogeneous glazing of the body to be glazed.

The flow rate of the refrigerated liquid 3 at the outlet of the pump 4 must be adapted to suit the object 1 in order to allow for the correct refrigeration of the body to be glazed. Indeed, if the body to be glazed and the chamber respectively have a large surface area and volume, the flow rate of the refrigerated liquid is set to a high value in order to allow for homogeneous cooling of the body to be glazed. For example, if the body to be glazed has the shape of a sphere, the optimum flow rate of the pump is higher in relation to the optimum flow rate of the pump within the scope of the example illustrated in FIGS. 1 and 2, where the body to be glazed has the shape of a cup.

The pressure of the refrigerated liquid in the sealed chamber can also be temporarily increased in order to allow the sealed chamber to be drained of any air bubbles or air present in the chamber prior to activation of the glazing system. The pressure thus allows the air trapped in the chamber to be removed by the dip tube, which provides the evacuation outlets situated at the top of the chamber.

According to other possible solutions, the air can be removed by a siphon mechanism or by a dedicated plug.

With reference to FIG. 1, the supply pipe 21 and the return pipe 22 pass through the base 11 of the container. Therefore, when the base 11 is resting on a suitable surface 6, the refrigeration circuit is not apparent and only the object 1 is visible.

Additionally, the supply pipe 21 and the return pipe 22 are of the isothermal type. These pipes therefore have the following advantages:

- they do not run the risk of becoming glazed,
- they are energy-saving,
- they allow the object 1 to be positioned at a distance from the refrigeration device 2.

According to one embodiment illustrated in FIGS. 1 and 2, the refrigerated liquid 3 contained in the vessel is maintained at a suitable temperature by means of an adjustable thermostat 27 and a conventional refrigeration system.

This conventional refrigeration system comprises a cooling evaporator 23 (immersed in the vessel 20) coupled to a compressor 24, to a condenser 25 and to an expansion valve 26.

The adjustable thermostat 27 is used to adapt the temperature of the refrigerated liquid 3 contained in the vessel 20 to suit the inner volume of the chamber 100, the exhibition conditions of the glazed object and the products displayed. Indeed, if the user observes that, due to the outside temperature, the temperature of the product displayed (for example a bottle containing a beverage) is too high, the thermostat must simply be set to a new temperature that is better suited to the conditions observed.

The adjustable thermostat can also be used according to the experience of the person using the glazing system to modify the appearance of the coat of rime surrounding the body to be glazed. Indeed, depending on the riming conditions, the colour, thickness and texture of the coat of rime can vary.

As shown in FIG. 1, the glazing system comprises a device for collecting the defrost water 5. This defrost water is transported to the refrigeration system, where it is used to cool the compressor 24.

Since the glazing system is designed in a mobile manner, for example such that it can be installed in a temporary manner within the scope of isolated events, the refrigeration device is provided with a stand-alone power supply (not shown). This stand-alone power supply can in particular be of the single-phase inverter type and allows for the formation and maintenance of the glazed layer on the body to be glazed 10 of the object 1 when the system is being moved.

According to one characteristic of the system, the refrigerated liquid is, for example, constituted from a brine or a mixture of glycol and water.

Secondarily, stirring elements are integrated into the vessel in order to prevent the creation of slush in the liquid (formation of small flaky ice cubes in the vessel that risk disrupting the refrigeration circuit).

Advantageously, the body to be glazed is made from a material of the heat conductor type, for example metal.

Preferably, the wall 12 has a constant thickness.

These advantageous characteristics contribute to the capacity of the object to quickly display a coat of rime with a uniform thickness after activation of the glazing system.

According to the principle of an exemplary embodiment of the invention, and when the system is placed in operation, the refrigerated liquid 3 contained in the vessel 20 is gradually brought to a set temperature configured using the thermostat 27. For example, the temperature of the refrigerated liquid is brought to −15° C.

Then, the pump 4 pumps the refrigerated liquid through the supply pipe 21 until it enters the chamber 100 of the body to be glazed 10 of the object 1. By filling the chamber 100, the refrigerated liquid 3 expels any air that may be contained in the chamber via the evacuation outlets 102 provided by the dip tube 103. Indeed, the air automatically escapes from the vessel under the effect of the rise in refrigerated liquid inside the chamber, then escapes from the dip tube under the effect of the pressure of the refrigerated liquid generated by the pump.

After removing the air from the sealed chamber and under the effect of the continual supply of refrigerated liquid to the chamber by the pump, the wall 12 (forming the body to be glazed) has a temperature that falls until it reaches a negative temperature.

This temperature drop is in particular homogeneous at all points on the wall 12 and allows, thanks to the riming phenomenon explained hereinabove, a homogeneous and uniform layer of rime to develop on the wall. Indeed, as can be seen in FIGS. 1 and 2, the refrigerated liquid enters the chamber 100 via the inlet 101, spreads throughout the chamber while cooling the body to be glazed 10 in a homogeneous manner, and is then removed through the evacuation outlets 102 provided by the dip tube 103.

Therefore, when the glazing system is in operation, the object has a conventional cup shape with a bowl covered by a uniform coat of rime.

According to another application example of the invention, not shown in the figures, the system can comprise a plurality of objects, each having one or more bodies to be glazed in order to form a particularly impressive, decorative, glazed display assembly. The refrigeration device system is thus adapted and can comprise, for example, a refrigerated liquid vessel with a high capacity (three hundred litres).

According to one characteristic, letters or patterns made from steel, brass or bronze are brazed in a raised manner on the body to be glazed. The rime therefore forms around these raised parts while visually and clearly preserving the appearance thereof. The coat of rime thus takes on a homogeneous and controlled thickness and appearance on the glazed body, except at these raised parts.

According to another characteristic, a lighting system is incorporated into the base. This lighting system contributes to the visual effect obtained by the glazing of the object by diffusing light within the coat of rime, for example by highlighting the glazed raised parts of the letters or patterns brazed on the body to be glazed.

According to one specific embodiment, the system comprises a timer for the refrigeration device, said timer in particular being coupled to the adjustable thermostat and to an external thermostat.

The system thus designed allows the activation of the refrigeration device to be programmed according to an establishment's opening and closing times. For example, the system can be activated automatically one hour before the establishment opens in order to generate the coat of rime.

The adjustable thermostat allows the temperature of the refrigerated liquid contained in the vessel to be precisely modulated, and the external thermostat allows for the determination of the ambient temperature to which the object displaying the body to be glazed is exposed. Using these two thermostats, the system allows the formation of the coat of rime to be automated and precisely adjusted, while allowing for a storage temperature of the products to be displayed that is stable and adjusted to the nearest degree.

Moreover, the timer can be adjusted in order to predictably change the characteristics of the coat of rime (thickness, structure, appearance, shape, etc.). These adjustments made to the timer can, for example, consist of cycles of operation and shutdown of the refrigeration device, variations in the temperature of the refrigerated liquid, or even modulations of the temperature of the refrigerated liquid as a function of the ambient temperature.

Although the present disclosure has been described with reference to one or more examples, workers skilled in the art will recognize that changes may be made in form and detail without departing from the scope of the disclosure and/or the appended claims.

The invention claimed is:

1. A glazing system comprising:

at least one object displaying at least one body to be glazed, wherein the body to be glazed incorporates a sealed chamber extending inside said body, the chamber having at least one inlet situated at a bottom of the chamber, at least one evacuation outlet situated at a top of the chamber, and inside wall and an outside wall which extend from the bottom of the chamber to the top of the chamber and from external surfaces of the body to be glazed; and a refrigeration device comprising a refrigeration circuit coupled to the inlet and the evacuation outlet to circulate a refrigerated liquid between the inlet and the evacuation outlet, wherein the inlet passes the refrigerated liquid to the sealed chamber at the bottom of the chamber, wherein the chamber incorporates at least one dip tube providing the evacuation outlet, the dip tube being situated inside the chamber and communicating with the refrigeration circuit, the at least one dip tube passing between an inside wall and an outside wall of the chamber and crossing the chamber from the bottom of the chamber to the top of the chamber in order to position the at least one evacuation outlet at the top of the chamber, the at least one dip tube being separated from the inside and outside walls of the chamber along at least part of a length of the at least one dip tube so as to define flow paths for the refrigerated liquid along the inside wall and the outside wall of the chamber in a direction from the bottom of the chamber to the top of the chamber, wherein the at least part of the length of the at least one dip tube that is separated from the inside and outside walls of the chamber extends from the bottom of the chamber.

2. The glazing system according to claim 1, wherein the refrigeration device comprises a vessel of refrigerated liquid from which a pump feeds the inlet with refrigerated liquid, and said at least one dip tube is coupled to a return pipe opening out into the vessel.

3. The glazing system according to claim 2, wherein the pump feeds the inlet via a supply pipe, and the supply pipe and the return pipe connect to the body to be glazed by passing through a base of the object.

4. The glazing system according to claim 3, wherein the supply pipe and the return pipe are of an isothermal type.

5. The glazing system according to claim 2, wherein the vessel is of an isothermal type and the refrigeration device comprises a cooling evaporator immersed in the vessel.

6. The glazing system according to claim 1, wherein the object is a container formed by a wall that constitutes the body to be glazed.

7. The glazing system according to claim 1, further comprising a device for collecting defrost water.

8. The glazing system according to claim 1, wherein the refrigeration device comprises an adjustable thermostat.

9. The glazing system according to claim 1, wherein the refrigeration device comprises a stand-alone power supply.

10. The glazing system according to claim 1, wherein the at least one dip tube is separated from the inside and outside walls of the chamber along the whole length of the at least one dip tube.

* * * * *